US012781751B2

(12) United States Patent
Lin et al.

(10) Patent No.: US 12,781,751 B2
(45) Date of Patent: Nov. 3, 2026

(54) CENTRIFUGAL HEAT DISSIPATION FAN

(71) Applicant: Acer Incorporated, New Taipei City (TW)

(72) Inventors: Yu-Ming Lin, New Taipei City (TW); Mao-Neng Liao, New Taipei City (TW); Cheng-Wen Hsieh, New Taipei City (TW); Kuang-Hua Lin, New Taipei City (TW); Chun-Chieh Wang, New Taipei City (TW); Tsung-Ting Chen, New Taipei City (TW)

(73) Assignee: Acer Incorporated, New Taipei City (TW)

( * ) Notice: Subject to any disclaimer, the term of this patent is extended or adjusted under 35 U.S.C. 154(b) by 0 days.

(21) Appl. No.: 19/392,146

(22) Filed: Nov. 18, 2025

(65) Prior Publication Data

US 2026/0146615 A1 May 28, 2026

(30) Foreign Application Priority Data

Nov. 27, 2024 (TW) ..... 113145761

(51) Int. Cl.

| | |
|---|---|
| ***F04D 17/16*** | (2006.01) |
| ***F04D 29/28*** | (2006.01) |
| ***F04D 29/42*** | (2006.01) |
| ***F04D 29/66*** | (2006.01) |

(52) U.S. Cl.

CPC ..... *F04D 17/16* (2013.01); *F04D 29/281* (2013.01); *F04D 29/4226* (2013.01); *F04D 29/663* (2013.01)

(58) Field of Classification Search

CPC ..... F04D 17/08; F04D 17/10; F04D 17/16; F04D 29/281; F04D 29/42; F04D 29/4206; F04D 29/4226; F04D 29/4246; F04D 29/663

See application file for complete search history.

(56) References Cited

U.S. PATENT DOCUMENTS

| | | | | |
|---|---|---|---|---|
| 2009/0060730 | A1* | 3/2009 | Hwang | F04D 29/30 415/203 |
| 2018/0051717 | A1* | 2/2018 | Wang | F04D 29/4226 |
| 2019/0277309 | A1* | 9/2019 | Horii | F04D 25/0613 |

(Continued)

FOREIGN PATENT DOCUMENTS

| | | |
|---|---|---|
| CN | 215214113 | 12/2021 |
| CN | 110892160 | 2/2022 |
| CN | 114810626 | 7/2022 |

(Continued)

*Primary Examiner* — Elton K Wong

(74) *Attorney, Agent, or Firm* — JCIPRNET

(57) ABSTRACT

A centrifugal heat dissipation fan suited for a laptop computer is provided. The centrifugal heat dissipation fan includes a housing having a plurality of recesses, a hub rotating disposed in the housing, and a plurality of blades disposed at side of and surrounding the hub. The blades are rotated in a direction along with the hub. The recesses face toward the blades, and a contour of each of the recesses is tapered along the direction. An airflow on a surface of the housing enters the recess when the centrifugal heat dissipation fan is operated. After the airflow being gathered together because of the tapered contour, the airflow is squeezed out of the recess and flows toward the blades.

13 Claims, 6 Drawing Sheets

(56) References Cited

U.S. PATENT DOCUMENTS

2024/0318662 A1* 9/2024 Wu ..... F04D 17/16

FOREIGN PATENT DOCUMENTS

| | | |
|---|---|---|
| JP | 2000130399 | 5/2000 |
| TW | 200541441 | 12/2005 |
| TW | I681130 | 1/2020 |
| TW | 202006256 | 2/2020 |

* cited by examiner

CENTRIFUGAL HEAT DISSIPATION FAN

CROSS-REFERENCE TO RELATED APPLICATION

This application claims the priority benefit of Taiwan application serial no. 113145761, filed on Nov. 27, 2024. The entirety of each of the above-mentioned patent applications is hereby incorporated by reference herein and made a part of this specification.

BACKGROUND

Technical Field

The disclosure relates to a heat dissipation fan, and in particular to a centrifugal heat dissipation fan.

Description of Related Art

The current electronics industry is developing rapidly. As the performance of electronic components continues to improve, the faster the computing speed, the greater the heat generated. Therefore, portable electronic devices, such as laptop computers, need to use centrifugal heat dissipation fans to discharge the air from the portable electronic device to reduce the internal temperature of the device. Furthermore, in order to comply with the current trend of devices that are thin, compact and high-performance, the centrifugal heat dissipation fan in portable electronic devices often faces insufficient configuration space.

For the centrifugal heat dissipation fan, its performance largely depends on the area of the blades. A larger fan blade area means that it can capture more air and generate a larger airflow. However, as the aforementioned configuration space is insufficient, when the space that the fan housing can provide for the blades is limited, the designer may increase the area of the blades as much as possible. As a result, the distance between the blades and the inner wall of the housing will become smaller and smaller.

But this also means that the motor, the hub and the blades need to be more stable during operation, otherwise the blades will easily deflect and hit the housing. On the contrary, during design, due to the above-mentioned stability considerations, the possibility of continued expansion of the blades area is limited.

SUMMARY

The present application provides a centrifugal heat dissipation fan, which can provide airflow during operation so that the blades can maintain stability relative to the housing.

The centrifugal heat dissipation fan of the present application is suited for a laptop computer. The centrifugal heat dissipation fan includes a housing, a hub, and a plurality of blades. The housing has a plurality of recesses. The hub is rotatably disposed in the housing. The blades are arranged around the hub to rotate in a direction with the hub. The recesses are faced toward the blades, and the contours of each of the recess is tapered along the direction. An airflow on a surface of the housing enters the recess when the centrifugal heat dissipation fan is operated. After the airflow being gathered together because of the tapered contour, the airflow is squeezed out of the recess and flows toward the blades.

Based on the above, the centrifugal heat dissipation fan responds to the trend of shrinking the internal space of the laptop computer, and sets a plurality of recesses on the surface of the housing. The recesses face toward the blades, and a contour of each of the recesses is tapered along the rotation direction of the blades. In this way, when the centrifugal heat dissipation fan is operating, the airflow on the surface of the housing passes through and enters the recess. After the airflow being gathered together because of the tapered contour, the airflow is squeezed out of the recess and flows toward the blades. Therefore, it is equivalent to generating airflow from the housing toward the blades when the blades rotate.

Accordingly, when these airflows are continuously generated due to the rotation of the blades, it is equivalent to forming an air wall between the housing and the blades, allowing the blades to maintain a gap with the housing during the rotation. It is also equivalent to stabilizing the rotation of the blades without deflecting, so as to avoid the blades from hitting the housing.

DESCRIPTION OF THE EMBODIMENTS

Figure 1:
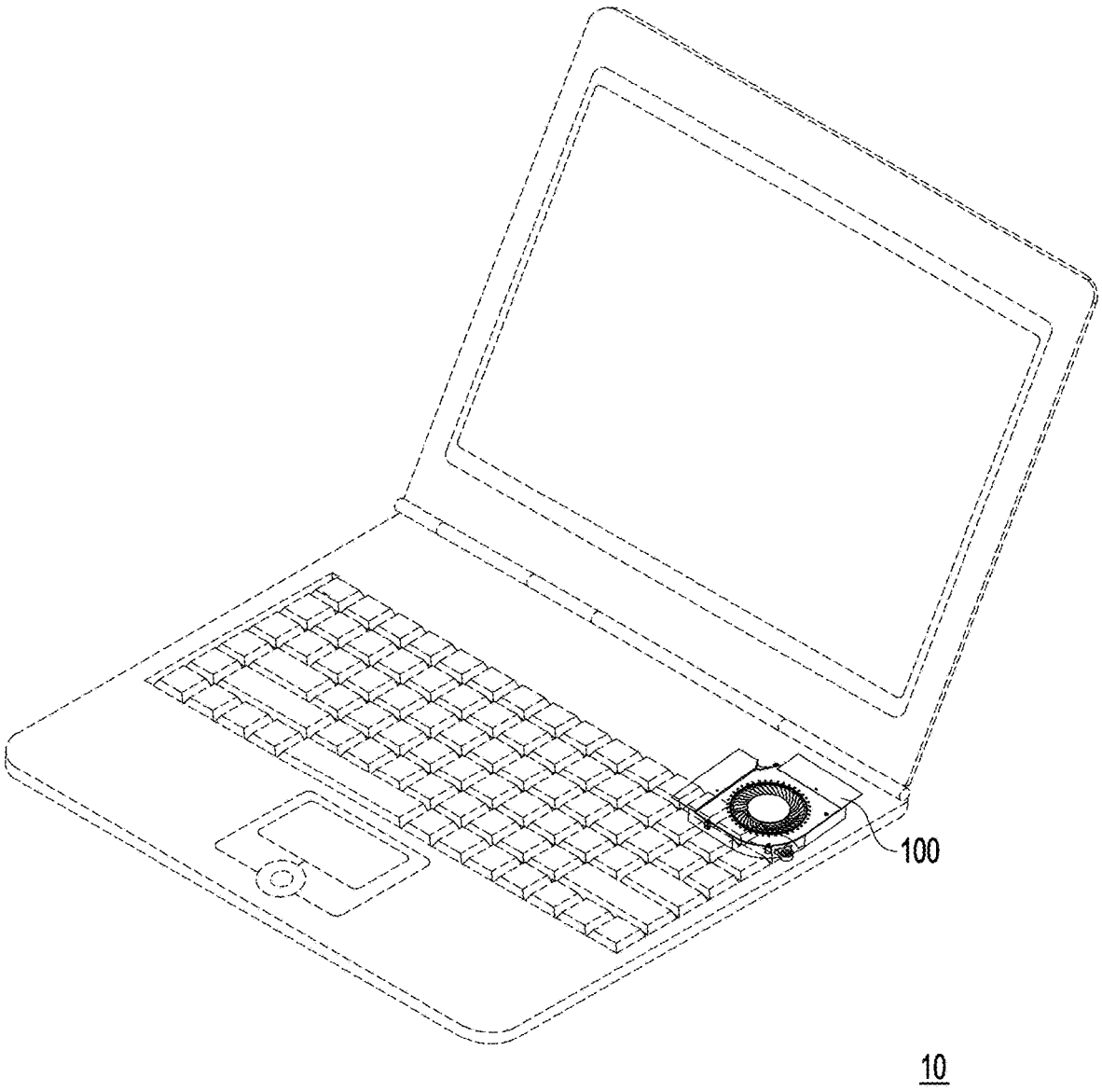
FIG. 1 is a schematic diagram of a laptop computer according to an embodiment of the present application.
Figure 2:
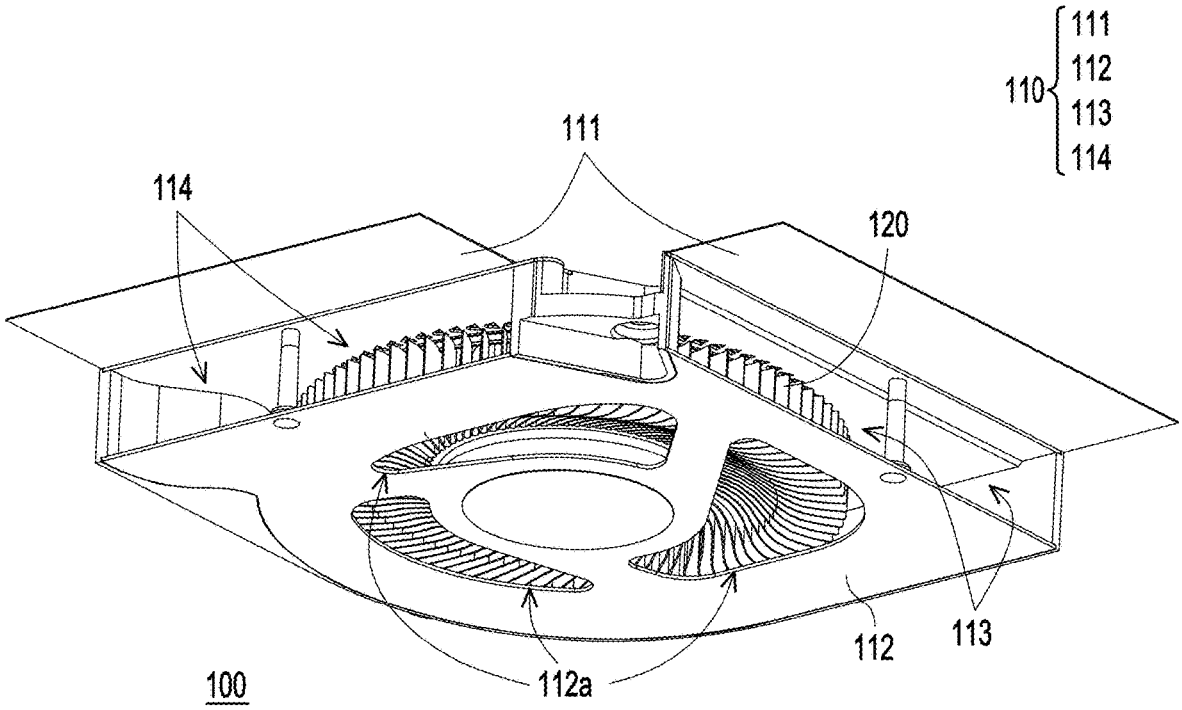
FIG. 2 is a schematic diagram of the centrifugal heat dissipation fan.
Figure 3:
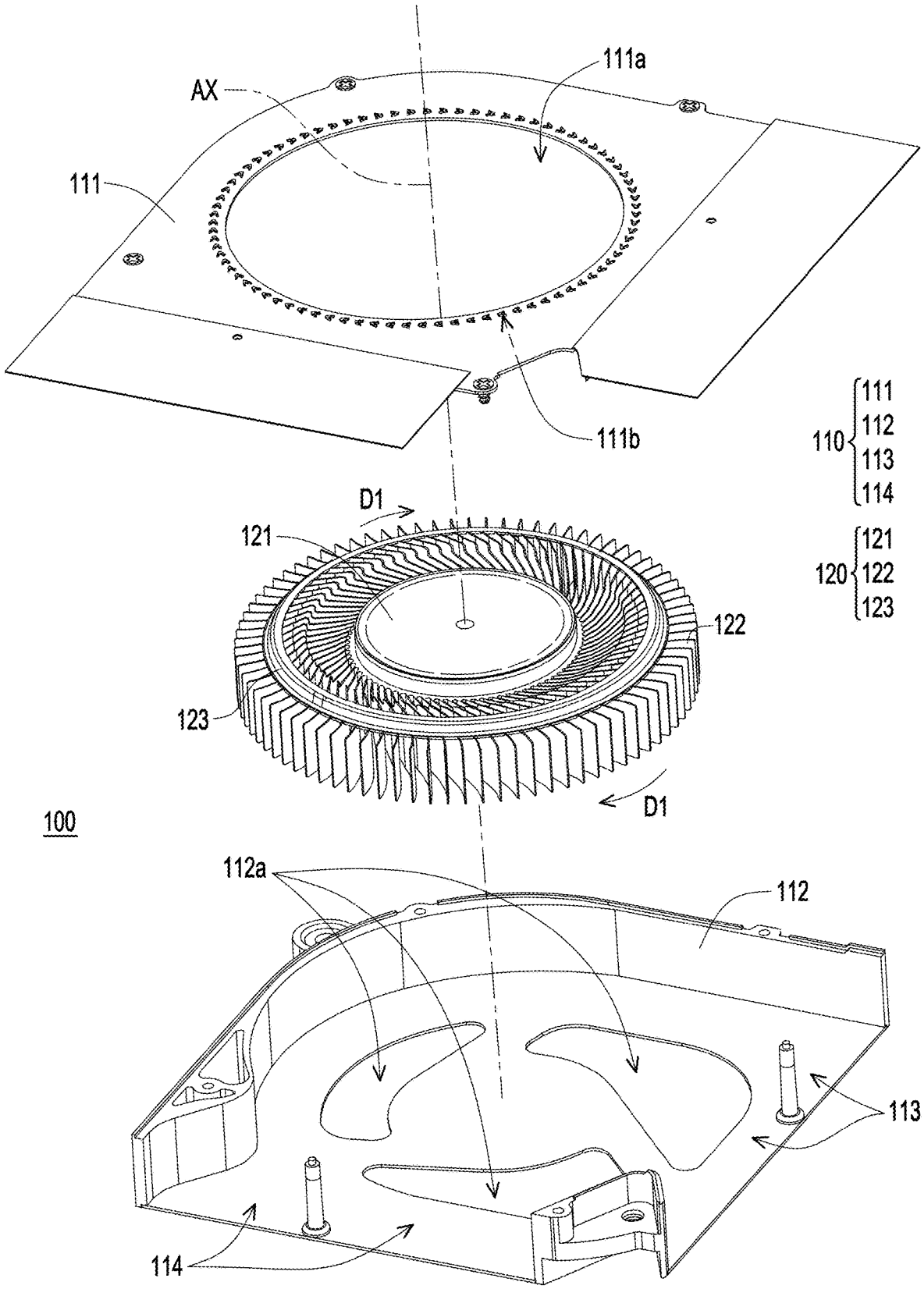
FIG. 3 is an exploded diagram of the centrifugal heat dissipation fan.

FIG. 1 is a schematic diagram of a laptop computer according to an embodiment of the present application. FIG. 2 is a schematic diagram of the centrifugal heat dissipation fan. FIG. 3 is an exploded diagram of the centrifugal heat dissipation fan. Referring to FIG. 1 to FIG. 3 at the same time, in the embodiment, the centrifugal heat dissipation fan 100 is suited for a laptop computer 10 to dissipate heat from a heat source (such as a CPU or GPU) within the laptop computer 10 to expel the heat out of the laptop computer 10. As shown in FIG. 2 and FIG. 3, the centrifugal heat dissipation fan 100 includes a housing 110 and a blade wheel 120, wherein the blade wheel 120 is connected to a motor (not shown) to rotate along a rotation axis AX in the housing 110. In the embodiment, the housing 110 includes a base 112 and a top plate 111, wherein the top plate 111 has an air inlet 111*a* and the base 112 has an air inlet 112*a*. And therefore, after the base 112 and the top plate 111 are combined with each other, air outlets 113 and 114 are further formed. Therefore, when the centrifugal heat dissipation fan 100 is operating, it will generate airflow that is sucked into the housing 110 from the air inlets 111*a*, 112*a*, and then discharged out of the housing 110 from the air outlets 113, 114.

Figure 4:
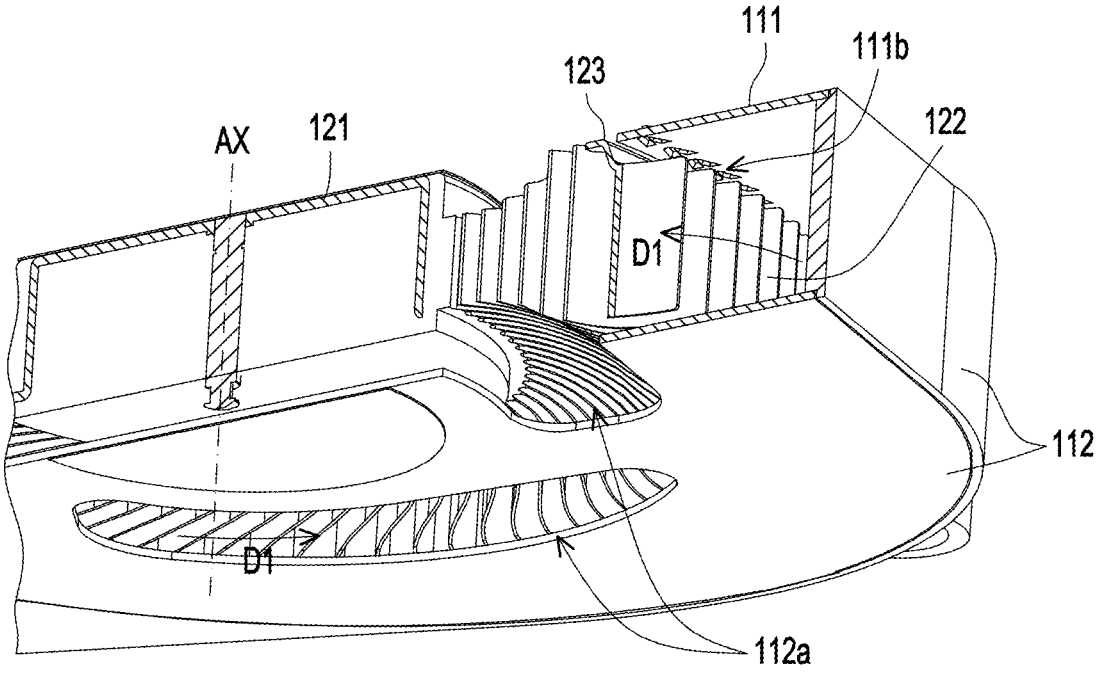
FIG. 4 is a partial cross-sectional view of the centrifugal heat dissipation fan.
Figure 5:
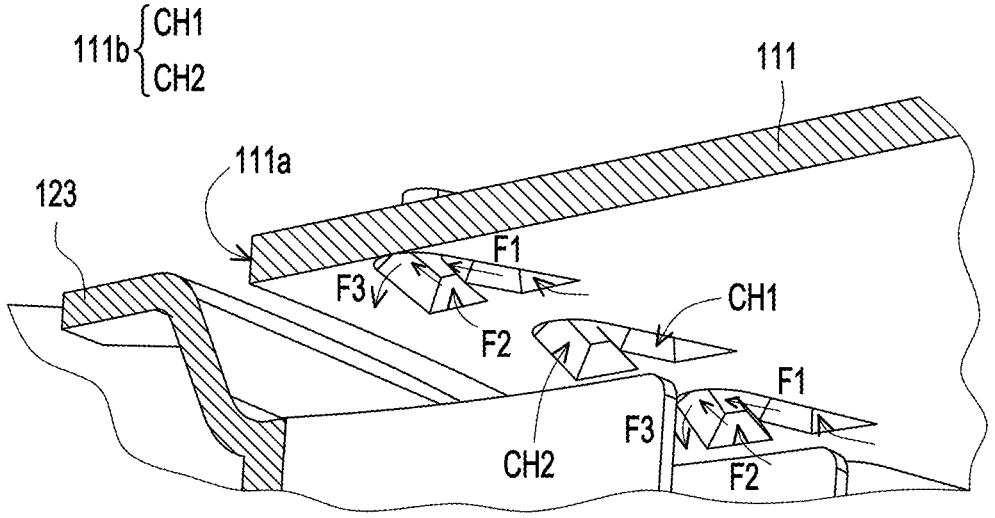
FIG. 5 is a partially enlarged diagram of FIG. 4.

FIG. 4 is a partial cross-sectional view of the centrifugal heat dissipation fan. FIG. 5 is a partially enlarged diagram of FIG. 4. Referring to FIG. 3 to FIG. 5 at the same time, in the embodiment, the top plate 111 of the housing 110 has a plurality of recesses 111*b* surrounding the air inlet 111*a*. The blade wheel 120 includes a hub 121, a plurality of blades 122, and a mute ring 123, wherein the he hub 121 is rotatably disposed in the housing 110. The blades 122 is arranged around the hub 121 to rotate in a direction D1 with the hub 121. The recesses 111*b* face toward the blades 122, and a contour of each of the recesses 111*b* is tapered along the direction D1.

Furthermore, the top plate 111 of the housing 110 has a plane. the recesses 111*b* are located on the plane and its depth direction is a normal direction of the plane, as shown in FIG. 4. The inner surface of the top plate 111 is provided with the recesses 111*b*, which is the above-mentioned plane, and the rotation axis AX can be regarded as the normal line of the plane. Furthermore, the recesses 111*b* of the embodiment are divided into a first flow channel CH1 and a second flow channel CH2 in the form of an arrow contour, and they intersect at one place along the direction D1. Therefore, when the centrifugal heat dissipation fan 100 is operating, the airflow on the surface of the top plate 111 may be divided into airflows F1 and F2 and enter the recesses 111*b*. And due to the tapered contour, they gather together and form airflow F3, which is squeezed out of the recesses 111*b* and blows toward the blades 122. Since the recesses 111*b* in the embodiment are equidistantly distributed, the airflow F3 squeezed out from the recesses 111*b* may form an air wall and provide thrust to the blades 122, thereby maintaining a constant gap between the blades 122 and the top plate 111 of the housing 110. The better one can keep the distance (gap) between the upper edge of the blades 122 and the top plate 111 at 0.6 mm. In another embodiment not shown, the recesses 111*b* may also have a triangular contour (and still taper along the direction D1).

Briefly speaking, the generation of the air wall is equivalent to allowing the rotational motion of the blades 122 to remain stable and no longer deflected by the airflow. Therefore, on the premise that the recesses 111*b* exist on the top plate 111, the fan designer can increase the area of the blades 122 as much as possible without any worries. In this way, it helps to increase the airflow of the centrifugal heat dissipation fan 100 and optimize the heat dissipation performance of the centrifugal heat dissipation fan 100.

In addition, the mute ring 123 of the embodiment is connected to the blades 122 and used to reduce the operating noise of the centrifugal heat dissipation fan 100 while increasing the structural strength of the blades 122. This part is already known in the prior art and will not be described again. It should also be mentioned that, as shown in FIG. 5, the mute ring 123 is roughly located within the range of the air inlet 111*a*. And its surface facing the top plate 111 is non-single plane, so it is not suitable to be arranged like the recesses 111*b* on the top plate 111.

Figure 6:
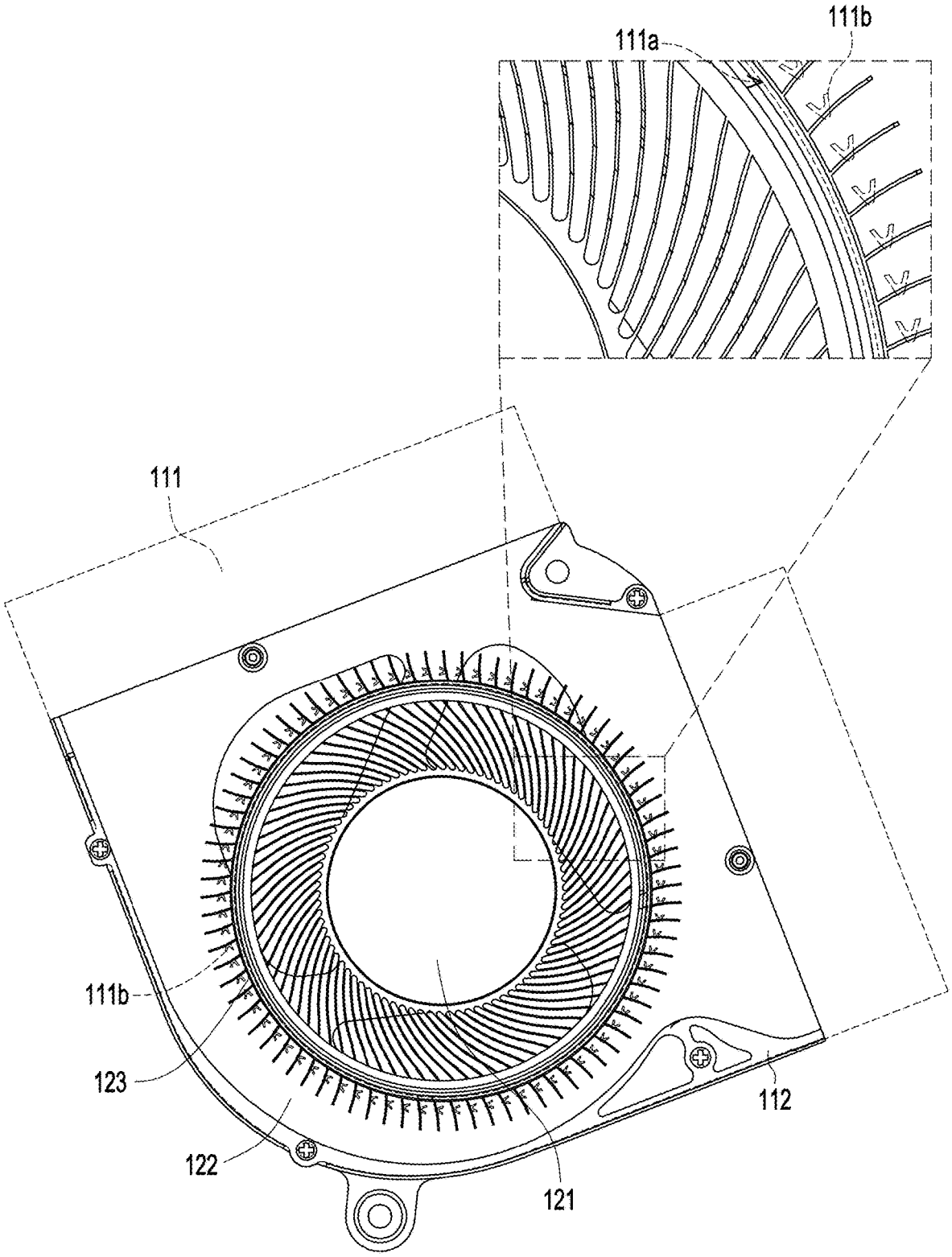
FIG. 6 is a top view of the centrifugal heat dissipation fan.

FIG. 6 is a top view of the centrifugal heat dissipation fan. Herein, the top plate 111 is made dotted (in perspective) to facilitate identification of the relative relationship between the recesses 111*b* and other components. Referring to FIG. 6, in the embodiment, the recesses 111*b* essentially surrounds outside the range of the mute ring 123. However, in other embodiments not shown, the recesses 111*b* may also be located on the mute ring 123 in the perspective shown in FIG. 6. In other words, the airflow F3 generated from the recesses 111*b* (as shown in FIG. 5) can directly push against the mute ring 123.

In another embodiment not shown, the recesses can also be disposed on the base 112. Briefly speaking, if the recesses are set based on the base 112, and the depth direction of the recesses is the normal direction of the plane where the base 112 is located. In another embodiment not shown, the recesses can also be disposed on the top plate 111 and the base 112.

Figure 7:
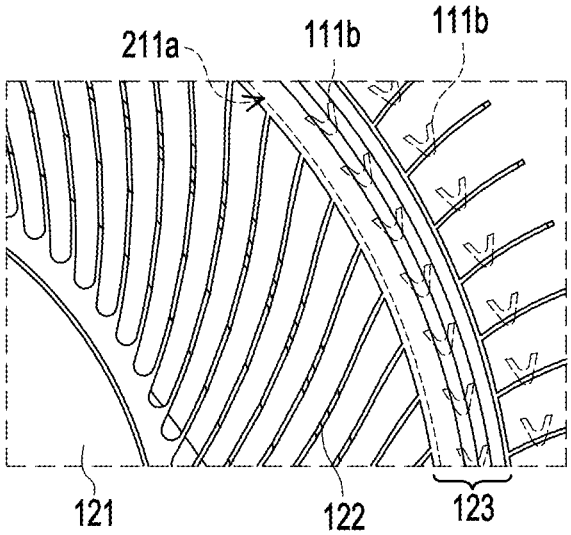
FIG. 7 is a partial top view of the centrifugal heat dissipation fan of another embodiment of the present application.

FIG. 7 is a partial top view of the centrifugal heat dissipation fan of another embodiment of the present application, which is shown in the same perspective and in the same partial manner as FIG. 6. Compared with the embodiment shown in FIG. 6, the recesses 111*b* of the embodiment shown in FIG. 7 are arranged in a plurality of circles with multiple radii relative to the rotation axis of the hub 121 and the blades 122, wherein the diameter of an air inlet 211*a* is smaller than the diameter of the air inlet 111*a* mentioned above. As shown in the figure, two rows of the recesses 111*b* are taken as an example to increase the airflow F3 generated from the recesses 111*b* when the blades 122 rotate (as shown in FIG. 5).

In summary, in the above-mentioned embodiment of the application, the centrifugal heat dissipation fan responds to the trend of shrinking the internal space of the laptop computer, and sets a plurality of recesses on the surface of the housing. The recesses face toward the blades, and a contour of each of the recesses is tapered along the rotation direction of the blades. In this way, when the centrifugal heat dissipation fan is operating, the airflow on the surface of the housing passes through and enters the recess. After the airflow being gathered together because of the tapered contour, the airflow is squeezed out of the recess and flows toward the blades. Therefore, it is equivalent to generating airflow from the housing toward the blades when the blades rotate.

Accordingly, when these airflows are continuously generated due to the rotation of the blades, it is equivalent to forming an air wall between the housing and the blades, allowing the blades to maintain a gap with the housing during the rotation. It is also equivalent to stabilizing the rotation of the blades without deflecting, so as to avoid the blades from hitting the housing. In this way, fan designers can increase the area of the blades as much as possible without any worries, which may help increase the airflow of the centrifugal heat dissipation fan and optimize the heat dissipation performance of the centrifugal heat dissipation fan.

What is claimed is:

1. A centrifugal heat dissipation fan, suited for a laptop computer, the centrifugal heat dissipation fan comprises:

a housing, having a plurality of recesses;

a hub, rotatably disposed in the housing;

a plurality of blades, arranged around the hub to rotate in a direction with the hub, wherein the recesses face toward the blades, and a contour of each of the recesses is tapered along the direction, an airflow on a surface of the housing enters the recess when the centrifugal heat dissipation fan is operated, and the airflow is gathered together because of the tapered contour and is squeezed out of the recess and flows toward the blades.

2. The centrifugal heat dissipation fan according to claim 1, wherein the housing has a base and a top plate, and at least one of the base and the top plate has an air inlet.

3. The centrifugal heat dissipation fan according to claim 2, wherein the recesses surround the air inlet.

4. The centrifugal heat dissipation fan according to claim 2, wherein the recesses surround the air inlet in an orthographic projection of the plane where the air inlet is located.

5. The centrifugal heat dissipation fan according to claim 2, wherein the recesses are located on at least one of the base and the top plate.

6. The centrifugal heat dissipation fan according to claim 2, further comprises a mute ring, connected to the blades, a surface of the mute ring facing the housing is non-single plane.

7. The centrifugal heat dissipation fan according to claim 2, wherein the top plate has a plane, a depth direction of the recesses is a normal direction of the plane.

8. The centrifugal heat dissipation fan according to claim 2, wherein the base has a plane, a depth direction of the recesses is a normal direction of the plane.

9. The centrifugal heat dissipation fan according to claim 1, wherein a depth direction of the recesses is parallel to a rotating axial direction of the hub and the blades.

10. The centrifugal heat dissipation fan according to claim 1, wherein the recesses are equidistantly distributed.

11. The centrifugal heat dissipation fan according to claim 1, wherein each of the recesses has a first flow channel and a second flow channel that intersect at one point along the direction.

12. The centrifugal heat dissipation fan according to claim 1, wherein each of the recesses has an arrow contour or a triangular contour.

13. The centrifugal heat dissipation fan according to claim 1, wherein the recesses are arranged in a plurality of circles with multiple radii relative to a rotation axis direction of the hub and the blades.

* * * * *